United States Patent [19]

Kemeny

[11] 4,369,692

[45] Jan. 25, 1983

[54] SWITCHING SYSTEM FOR HIGH DC CURRENT

[75] Inventor: George A. Kemeny, Wilkins Township, Allegheny County, Pa.

[73] Assignee: Westinghouse Electric Corp., Pittsburgh, Pa.

[21] Appl. No.: 279,925

[22] Filed: Jul. 2, 1981

Related U.S. Application Data

[63] Continuation of Ser. No. 100,302, Dec. 4, 1979, abandoned.

[51] Int. Cl.[3] ..... F41F 1/02

[52] U.S. Cl. ..... 89/8; 124/3; 310/12; 307/143

[58] Field of Search ..... 89/8; 124/3; 310/12, 310/14, 302; 318/135; 307/112, 139, 143

[56] References Cited

U.S. PATENT DOCUMENTS 3,148,587 9/1964 Melhart ..... 124/3

3,431,816 3/1969 Dalie ..... 124/3

OTHER PUBLICATIONS

"Moving Contacts in Macro-Particle Acceleration", R. A. Marshall, Australian National University (No Date).

"Proceedings of Impact Fusion Workshop" (7/10-12/79) La-8000-C, Los Alamos Scientific Lab.

"Electromagnetic Acceleration of Macro Particles to high Velocities", Rashleigh et al., 11/16/77, J. Appl. Phys. pp. 2540-2542.

"Acceleration of Macro Particles-Hypervelocity Em Accelerator", J. P. Barber (3/72) Doc. Thesis Report EP-TR12 Australian National University.

*Primary Examiner*—Sal Cangialosi

*Attorney, Agent, or Firm*—F. J. Baehr, Jr.

[57] ABSTRACT

A switching system for commutating high DC current from a first to a second pair of conductors comprising a switching armature slidably engaging the first pair of conductors, insulating inserts disposed on the first pair of conductors adjacent the second pair of conductors and means for drawing two series arcs between the armature and the first pair of conductors as the current is commutated to the second pair of conductors.

25 Claims, 12 Drawing Figures

SWITCHING SYSTEM FOR HIGH DC CURRENT

This is a continuation of application Ser. No. 100,302, filed Dec. 4, 1979, now abandoned.

BACKGROUND OF THE INVENTION

This invention relates to a switching system for high DC current and more particularly to rapidly switching current from one pair of conductors to another pair of conductors utilized to produce an electromagnetic force for launching a projectile.

FIG. 1 schematically shows the prior art circuitry employed to commutate the current from an inductive energy source into a projectile rail of a direct current electromagnetic projectile launcher. The operation is as follows. A homopolar generator rotor is brought up to the required rotational speed by a prime mover (not shown) after which a make switch is closed. The kinetic energy provided by the prime mover is transferred to the rotor of the homopolar machine, which converts the kinetic energy to DC electrical energy, which is then transferred and stored in an induction coil. When a predetermined current is reached, a switching armature is released and is electromagnetically propelled past a projectile rail breech and the current is commutated to the projectile rails and the projectile armature. The switching armature is decelerated and continues to conduct current into the projectile rails accelerating the projectile armature and launching the projectile.

FIG. 2 shows the prior art breech in more detail, showing an insulating insert disposed over the breech to provide the arc start location ad a smooth rail surface for the switching armature. The armature is shown made up of sheets of conductive material, preferably copper, stacked one against another to form a bundle of sheets extending from rail to rail. Performance of this system was good and up to about 300,000 amps it successfully commutated the current into the projectile rail system in less than 100 microseconds. After each firing, it was only necessary to replace the last few copper sheets adjacent the trailing end of the switching armature as these consistently overheated and failed on the arcing side.

Among the objects of this invention are the improvement of the armature so as to preclude armature repair after each firing, to provide extended switch operation without any refurbishing, and to greatly increase the current carrying capacity of the switching system.

One method of increasing the life of the switching armature would be to make it longer, while maintaining the same size insulating strip. This would yield a decrease in the maximum armature current density, and hence a decrease in the heating rate, and a decrease in the force on the individual sheets. Consequently, the life of the armature would be increased. However, it would also increase the commutation time; that is, the time interval between the initiation of the current flow into the projectile rail and the full current flow into the projectile rail.

SUMMARY OF THE INVENTION

In general, a switching system for switching high DC current fed into a first pair of generally parallel conductors from an electrical power source to a second pair of conductors, when made in accordance with this invention, comprises an armature slidably engaging the first pair of conductors, means for releasably latching the armature adjacent one end of the first pair of conductors, means for rapidly propelling the armature from the one end of the first pair of conductors to the other end thereof. The second pair of conductors are disposed adjacent the other end of the first pair of conductors and are disposed in electrical contact with at least one of the conductors of the first pair. At least one insulating strip is disposed on one of the conductors of the first pair adjacent the second pair of conductors and at least one arc resistant insert may be disposed on at least one of the conductors of the first pair adjacent the insulating strip and on the side thereof adjacent the one end of the first pair of conductors, whereby when the armature is rapidly propelled from the one end of the first pair of conductors to the other end, the high current in the first pair of conductors is switched to the second pair of conductors rapidly without substantially damaging the armature.

BRIEF DESCRIPTION OF THE DRAWINGS

The objects and advantages of this invention will become more apparent from reading the following detailed description in connection with the accompanying drawings in which.

DESCRIPTION OF THE PREFERRED EMBODIMENTS

Figure 1:
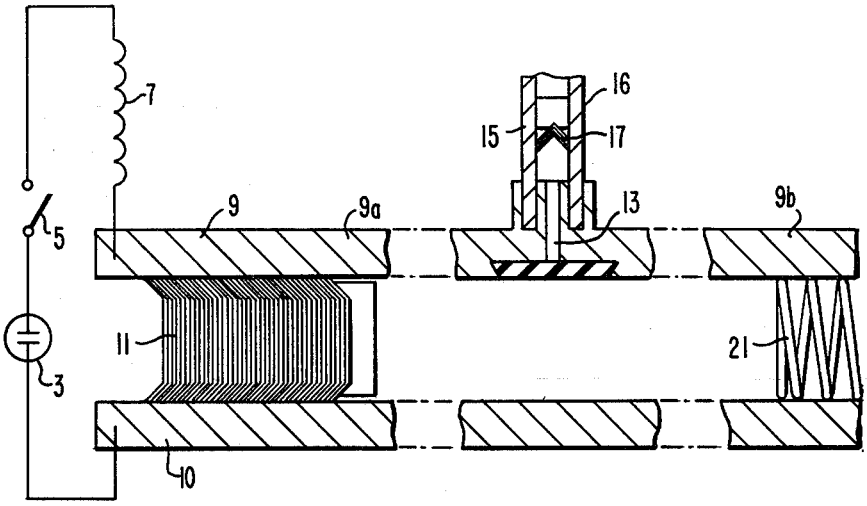
PRIOR ART FIG. 1
FIG. 1 is a schematic diagram of the prior art.
Figure 2:
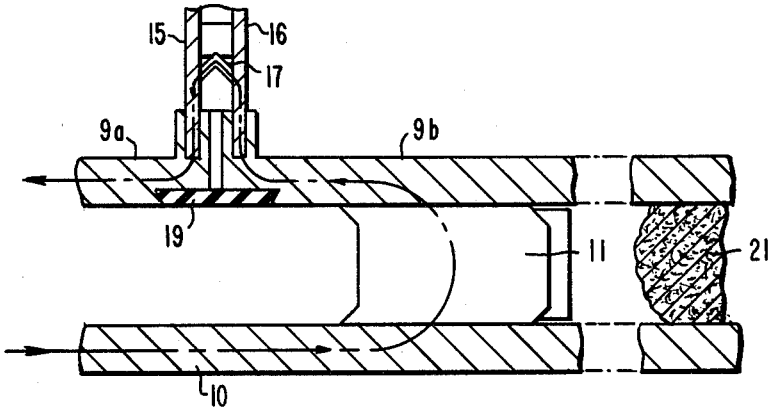
PRIOR ART FIG. 2
FIG. 2 is a partial sectional view of the prior art shown in FIG. 1.

Referring now to the drawings in detail, FIGS. 1 and 2 show a schematic diagram of a prior art circuit and system for electromagnetically accelerating a projectile. The circuit and system comprises a source capable of producing a high DC current such as a homopolar generator 3, a make switch 5 and an inductance coil 7 connected in series to a first pair of parallel conductive rails or conductors 9 and 10 electrically connected by a first or switching armature 11, which slidably engages the conductive rails 9 and 10. A gap or breech 13 is disposed in the conductor 9 separating the conductor 9 into two separate portions **9*a* and 9*b*, which are electrically separated by the gap 13. A second pair of conductive rails or conductors 15 and 16 are, respectively, electrically connected to each portion 9*a* and 9*b* of the conductor 9 on opposite sides of the gap 13 and a second or projectile armature 17 is disposed to slidably engage the conductive rails 15 and 16**.

As shown in FIG. 2, the gap or breech 13 is covered by an insulating insert or strip 19 to provide an arc starting location and a smooth path over which the switching armature 11 can pass and a bumper or other kinetic energy absorbing means 21 is disposed at the end of the first pair of rails 9 and 10 to stop the switching armature 11.

Figure 3:
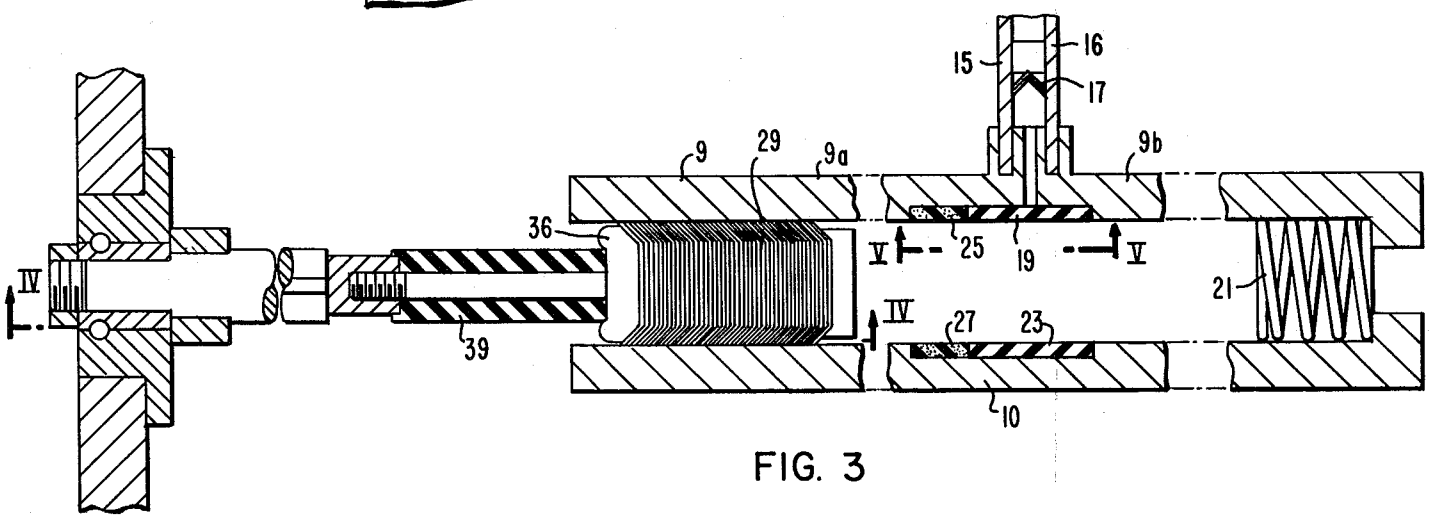
FIG. 3 is a sectional view showing the invention.

FIG. 3 shows an improvement in the system in which a second insulating insert or strip 23 is disposed on the conductor 10 opposite the insulating strip 19 on the conductor 9. Arc resistant inserts 25 and 27 are disposed on the leading ends of the insulating strips 19 and 23, respectively, and are interposed between the conductors 9 and 10 and a switching armature 29, which slidably engages the first pair of conductors 9 and 10.

Figure 6:
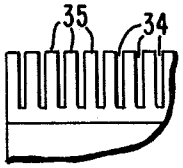
FIG. 6 is a partial elevational view of a portion of an armature sheet in its electrical contact area.
Figure 4:
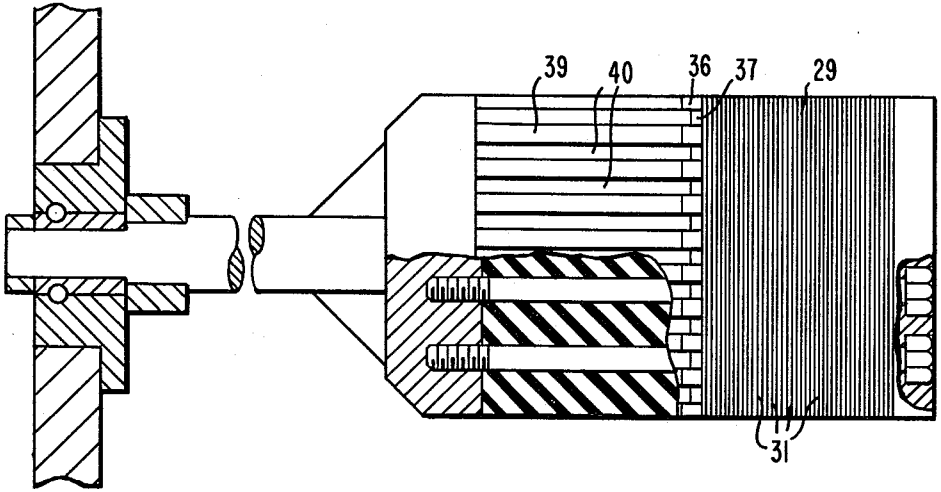
FIG. 4 is a partial sectional view taken on line IV—IV of FIG. 3.

As shown in FIGS. 3 and 4, the switching armature 29 differs from the switching armature 11 in the prior art in that axial armature current conduction must be substantially prevented and this is accomplished by having the conductive sheets 31 stacked to form the armature 29 and having insulator sheets disposed between adjacent conductive sheets 31. It is understood that an insulating coating could be applied to each sheet or that the contact resistance between sheets may inherently give sufficient resistance to current flow and this may be the preferred method of manufacturing said sheets 31. The margins of the conductive sheets 31, which contact the conductors 9 and 10 are bent at an angle of approximately 45° toward the trailing end of the armature 29 and are free of any insulation and as shown in FIG. 6 have a plurality of grooves 34 disposed to form fingers 35 in order to make good multi-point electrical contact with the conductors 9 and 10 as they slide thereon. An arc horn structure 36 is disposed on the trailing end of the armature 29 and is made of an arc resistant material such as sintered tungsten impregnated with copper, and is spaced from the conductors 9 and 10 so that it does not make contact with them and does not carry current as it travels along the conductors 9 and 10. Thus, the arc horn structure 36 is not preheated prior to carrying the arc current during the brief arcing period. The arc horn structure 36 may have a plurality of kerfs 37, which extend inwardly from the surface adjacent the conductors 9 and 10 forming a crenelated or notched surface adjacent the conductors 9 and 10 to provide multiple arcing surfaces and a plurality of arc attachment locations. An arc separator 39 made of Teflon or other suitable insulating material is connected to the trailing end of the arc horn structure 36 and is spaced from the conductors 9 and 10 to provide room for the arcs and subtends the conductors to prevent any possibility of the separate arcs formed between the arc horn structure 36 and the separate rails 9 and 10 from coalescing into an arc extending from rail to rail. The arc separator 39 may be spaced close to the conductors and be furnished with suitable grooves 40 and partitions to aid in establishing, maintaining and rapidly cooling multiple arcs. Teflon, which may be utilized to form the arc separator 39, and is an ablative material; that is, it gives off a gas when heated which aids in removing heat from the arc and thus assists in more rapid cooling and extinguishing of the arcs.

Figure 5:
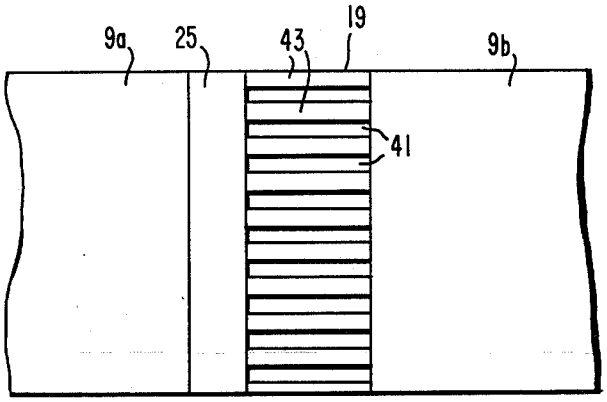
FIG. 5 is a partial sectional view taken on line V—V of FIG. 3.

As shown in FIG. 5, the insulating strips 19 and 23 may have a plurality of grooves 41 and partitions 43, which form an arc shute structure. There may be a plurality of grooves in the axial direction as well as in the transverse direction. the insulating material may be Teflon or some other ablative material, which gives off gas as it is heated in order to further cool the arcs.

Figure 7:
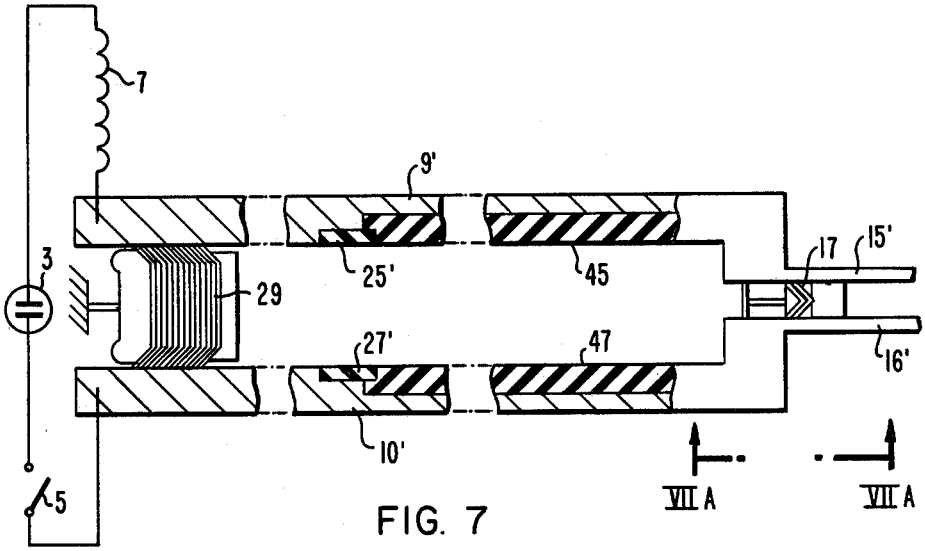
FIG. 7 is a schematic diagram of an alternate embodiment.

FIG. 7 shows an alternate embodiment in which the armature 29 is disposed to slidably engage a first pair of conductive rails or conductors 9' and 10', a source of high DC current is connected to one end of the conductors 9' and 10' and a second pair of conductive rails or conductors 15' and 16' are connected to another end of the conductors 9' and 10', respectively. Insulating inserts or strips 45 and 47 are spaced from the one or are disposed adjacent the other ends of the rails 9' and 10' adjacent the rails 15' and 16'. The insulating strips 45 and 47 are disposed between the armature 29 and the conductive rails 9' and 10' and are longer than the armature 29 so as to take the armature 29 out of the circuit when the armature slides onto the insulating strips 45 and 47. Arc resistant inserts 25' and 27' are disposed on the leading ends of the insulating inserts or strips 45 and 47 so as to be disposed between the conductive rails 9' and 10' and the armature 29.

Figure 7A:
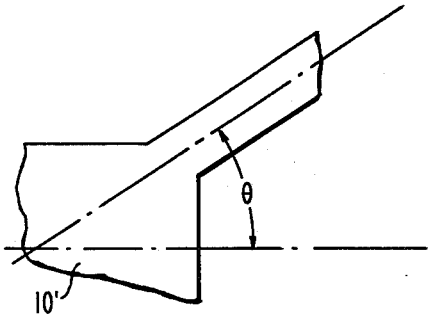
FIG. 7A is a partial sectional view taken on line VII—VII of FIG. 7.

As shown in FIG. 7A the axis of the second pair of conductors 15' and 16' may be disposed at any angle $\theta$ with respect to the axis of the first pair of conductors and the armature 29 can slide beyond the attachment point of the second set of rails 15' and 16' to the first pack of rails 9' and 10' and be ejected from the first pair of conductors, if the angle $\theta$ is greater than zero. This has the advantage of eliminating the need for the energy absorbing means 21.

Figure 10:
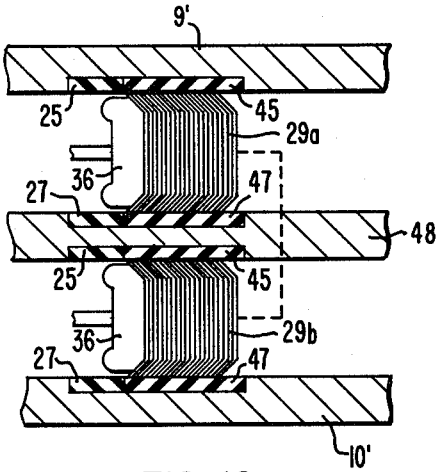
FIG. 10 is a partial schematic diagram of an alternate embodiment.

FIG. 10 shows an alternate embodiment in which a separate conductor 48 is disposed generally parallel to and in between the conductors 9' and 10' of the first pair of conductors. The separate conductor like the conductors 9' and 10' has a pair of insulating strips 45 and 47 and arc resistant inserts 25 and 27 disposed adjacent the leading end of the insulating strips 45 and 47 respectively. A plurality of armatures **29*a* and 29*b* are slidably disposed between the separate conductor 48 and the conductors 9' and 10' respectively. Preferably, the armatures 29*a* and 29*b* are mechanically linked, but electrically separated except for the separate conductor disposed therebetween. As the trailing ends of the armatures 29*a* and 29*b* reach the insulator strips 45 and 47, multiple series arcs are formed between the arc horn structures 36 and the respective arc resistant inserts increasing the arc voltage across the switching system by the number of arcs formed. Thus, to further increase the arc voltage, additional separate conductors, armatures, insulating strips and arc resistant inserts may be utilized in a like manner. One of the conductors 9 of the first pair has a gap therein and one of the insulation strips 45 is disposed over the gap. The second pair of conductors, 5' and 16' is individually connected to each portion of the conductor 9'** adjacent the gap.

Figure 11:
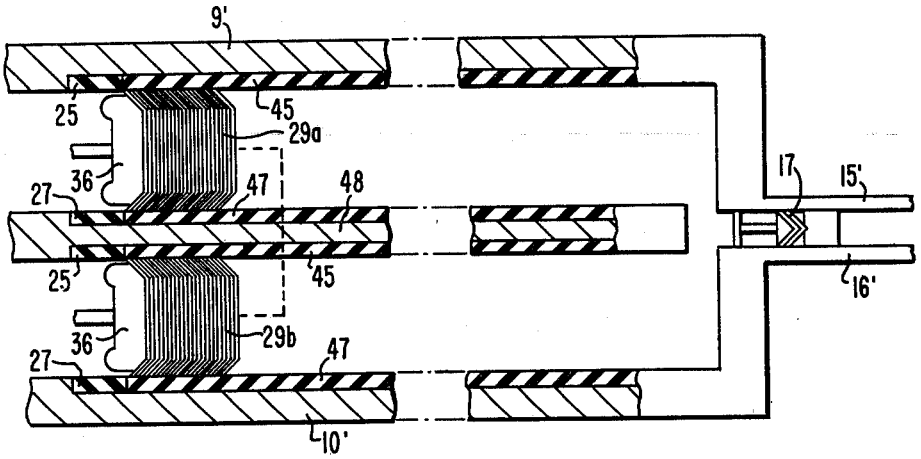
FIG. 11 is a partial schematic diagram of an alternate embodiment.

FIG. 11 is similar to FIG. 10 except that the second pair of conductors 15' and 16' is electrically connected to the respectively conductors 9' and 10' of the first pair of conductors in the same manner as was shown in FIGS. 7 and 7A, however, this arrangement provides additional series arcs to increase the voltage available to switch the current from the first to the second pair of conductors.

Figure 8:
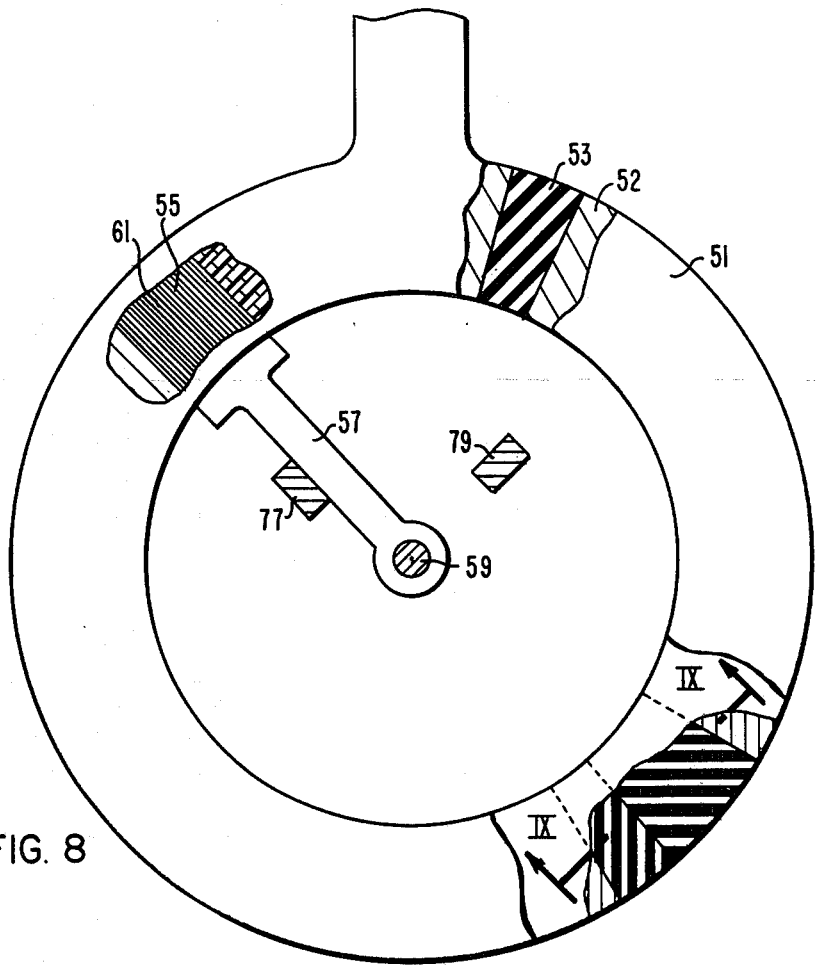
FIG. 8 is a partial sectional view of still another alternate embodiment.
Figure 9:
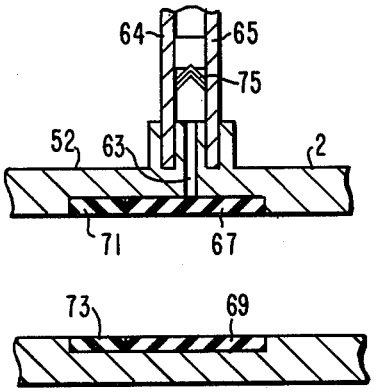
FIG. 9 is a sectional view taken on line IX—IX of FIG. 8.

FIGS. 8 and 9 show still another embodiment in which a first pair of parallel circular disc-shaped conductors 51 and 52 are connected to a source of high DC current (not shown). Each disc has an insulating insert 53 preventing the current from flowing 360° around the conductors 51 and 52. A switching armature 55 is disposed to slidably engage the conductors 51 and 52 and a pivot arm 57 is pivotally disposed on a pin 59 axially aligned with the center of the disc-shaped conductors 51 and 52 and connected to the armature 55 allowing it to follow a circular path between the conductors 51 and 52.

The switching armature 55 is formed from a plurality of conductive sheets 61, constructed to substantially prevent current flow in the direction of armature movement. The margins of the sheets 61 are bent approximately 45° toward the trailing end of the armature 55 to maintain good electrical contact with the conductors 51 and 52. As the armature 55 travels around the conductors 51 and 52, the electromotive force induced by the current tends to straighten the bent portions of the sheets 61 and maintain very good electrical contact. The conductor 52 has a breech or gap 63 disposed therein and a second pair of conductive rails or conductors 64 and 65 are connected to the conductor 52. One conductor 64 or 65 is connected on each side of the breech 63. Insulating inserts or strips 67 and 69 are disposed on each of the conductors 51 and 52, respectively, adjacent the breech 63. The insulating insert 67 is disposed over the breech 63 providing a smooth path for the switching armature. Arc resistant inserts 71 and 73 may be disposed adjacent the leading edges of the insulating inserts 67 and 69 separating the conductors from the armature 55. A projectile armature 75 is disposed between the conductive rails 64 and 65. A movable latch 77 is provided to hold the switching armature 55 until the current in the system reaches a predetermined level and a retractable bumper 79 in combination with other decelerating means are disposed to stop the switching armature 55 after it passes the insulating strips 67 and 69.

The operation of the system is as follows.

A source of DC power such as a homopolar generator 3 converts rotating kinetic energy previously supplied by a prime mover (not shown) to DC electrical energy, which is stored in the magnetic field of an induction coil 7. The DC electrical energy may typically be supplied at initially approximately 120 volts and at a current which rises to 1.5 million amperes. The induction coil 7 may have an inductance in the order of 7 microhenries and the circuit including the switching armature may have a resistance of approximately 30 micro-ohms. When the current in the circuit builds up to approximately 1.5 million amperes, the armature 29 is released, electromagnetic forces accelerate it along the conductors 9 and 10. While in the preferred embodiment, electromagnetic forces are utilized to accelerate the switching armature 29, it should be understood that other means may be utilized to accelerate the switching armature such as magnetic, hydraulic, explosive, impact, or springs, either singularly or in any combination thereof including a combination with electromagnetically induced forces. As the rapidly moving switching armature 29, which has been accelerated to a velocity of approximately 50 meters per second, reaches the insulating strips 19 and 23 and progresses thereon, the current flowing across the armature 29 is first crowded into the trailing conductive sheets 31 and when these last sheets 31 pass the leading edge of the insulating inserts 19 and 23, two series arcs are produced between the arc horn structure 36 and the arc resistant inserts 25 and 27 disposed at the leading end of the insulating strips 19 and 23. As the leading end of the switching armature 29 passes the insulating strips 19 and 23, the new current flow path is established and current is commutated or switched to the projectile armature 17. Since the current flowing in the original flow path develops an arc voltage as the path through the leading end of the switching armature 29 is made, that arc voltage results in the current being rapidly transferred to the leading end of the switching armature 29 and at the same time the length of the arcs are being increased, whereby the voltage for switching is increased. Simultaneously the arcs are extinguished rapidly without substantially damaging the armature 29 or conductors 9 and 10. Having insulating strips 19 and 23 on both conductors 9 and 10 and providing a shield 39 therebetween insures that two arcs develop and that these arcs do not coalesce into a single arc between the conductors 9 and 10. The two arcs are disposed in series thereby doubling the arc voltage compared to that developed by the prior art. Doubling the arc voltage doubles the rate of current injection into the second pair of conductors 15 and 16. In essence, arcing time is reduced by a factor of approximately two, which will substantially decease arc damage and, if desired, a longer switching armature may be used to result in lower armature current density, lower temperatures and longer life. It should be noted that the insulation between adjacent sheets of copper or other insulation or resistance in the armature 29 generally prevents current from flowing in the armature except in a direction directly across from conductor to conductor. There is little or no axial flow of current.

In the Figures other than FIGS. 7 and 7A, the circuitry is such that there is no current flowing through the projectile armature 17 until the start of commutation. However, a minor parasitic current can be allowed to flow prematurely through the projectile armature 17 during the inductance charging period, if it only produces insignificant heating of the armature and no premature movement. The projectile armature 17 can have a latch or other holding means to hold it in place during this period as shown in FIG. 7. A system as shown in FIG. 7, wherein the switching armature 29 is not required to carry current after the commutation of the current to the projectile armature 17 has the advantage of substantially reducing the magnitude of energy, which must be absorbed in order to bring the switching armature 29 to rest as the electromagnetic forces acting on the switching armature 29 after current commutation is completed greatly add to the energy which must be absorbed by, or transferred to, the armature decelerating means.

The circular conductors 51 and 52, shown in FIGS. 8 and 9 have the advantage of moving the switching armature 55 in a circular path so that with a minimal movement of the armature 55, it can be made ready for the next switching operation.

An important feature of this invention is utilizing a switching armature, which is accelerated over a relatively long distance before commutation starts and arc interruption is required, thus allowing the switching armature to reach a high velocity in the range of 50 meters per second. Most circuit breakers draw arcs at a very low separating speed and attain a top speed in the order of 9 meters per second. A large number of such breakers disposed in parallel conceivably could be utilized for the commutation of millions of amps of current into a projectile rail breech; however, this cannot be done as compactly, as inexpensively, with low losses, quickly, and with low commutation voltages.

What is claimed is:

1. A rail gun switching system for switching high DC current fed into a first pair of generally parallel rail conductors from an electrical power source to a second pair of conductors, said switching system comprising:

an armature slidably engaging said first pair of conductors;

means for initially restraining said armature adjacent one end of said first pair of conductors;

means for rapidly propelling said armature from said one end of said first pair of conductors to an other end thereof;

said second pair of conductors spaced from said one end of said first pair of conductors and being disposed in electrical contact with at least one conductor of said first pair of conductors; and an insulating strip disposed on both of said conductors of said first pair of conductors adjacent said second pair of conductors;

whereby when said armature is rapidly propelled from said one end of said first pair of conductors to said other end the high current in said first pair of conductors is rapidly switched to said second pair of conductors.

2. The switching system as set forth in claim 1, wherein the armature comprises a plurality of sheets of conductive material disposed transverse to the conductors, said sheets being electrically insulated from each other and stacked in a bundle, and the margins of said sheets engage the first pair of conductors.

3. The switching system as set forth in claim 1, wherein one of the conductors of said first pair has a gap disposed therein and the first insulating strip is disposed over the gap and extends on both sides thereof, and said second pair of conductors are individually connected to each portion of the one conductor of the first pair adjacent the gap.

4. The switching system is set forth in claim 3, and further comprising a second armature disposed to slidably engage the second pair of conductors.

5. The switching system as set forth in claim 1, wherein the armature has an arc horn structure disposed on the trailing end thereof.

6. The switching system as set forth in claim 1, wherein the armature has an insulator extending from the trailing end thereof and generally aligned with the axis of the armature.

7. The switching system as set forth in claim 1, wherein the conductors of the second pair of conductors are electrically connected to the respective conductors of the first pair of conductors.

8. The switching system as set forth in claim 1, wherein each conductor in the first pair has an arc resistant insert interposed between the conductor and the armature adjacent the leading end of the insulating strips.

9. The switching system as set forth in claim 7, wherein each pair of conductors has a central axis and the axises are disposed to form an angle between 0° and 180°.

10. The switching system as set forth in claim 9 and further comprising an arc shute disposed adjacent the trailing end of the arc resistant insert.

11. The switching system as set forth in claim 9 and further comprising a second armature slidably engaging said second pair of conductors.

12. The switching system as set forth in claim 3, wherein the armature comprises a plurality of sheets of conductive material disposed transverse to the conductors, said sheets being electrically insulated from each other and stacked in a bundle.

13. The switching system as set forth in claim 1, wherein said first pair of conductors is circularly disposed with an insulating portion in the circular structure preventing a circular flow of current.

14. The switching system as set forth in claim 13 and further comprising a second insulating strip, one insulating strip being disposed opposite the other on each conductor.

15. The switching system as set forth in claim 14, wherein the armature is mounted on an arm pivotally mounted on a shaft axially aligned with the center of the first pair of circular conductors.

16. The switching system as set forth in claim 15 and further comprising a retractable decelerating means for stopping the armature as it reaches the other end of the pair of circular conductors.

17. The switching system as set forth in claim 14, wherein one of the circular conductors has a gap disposed therein and the insulating strip is disposed over the gap and extends on both sides thereof and said second pair of conductors are electrically connected to each portion of the one conductor of the first pair adjacent the gap.

18. The switching system as set forth in claim 17, wherein the armature comprises a plurality of sheets of conductive material disposed transverse to the conductors, said sheets being electrically insulated from each other and stacked in a bundle.

19. The switching system as set forth in claim 17 and further comprising a second armature disposed to slidably engage the second pair of conductors.

20. The switching system as set forth in claim 17, wherein the insulating strips have arc shute notches disposed therein.

21. The switching system as set forth in claim 7, wherein each insulating strip has a plurality of notches disposed to form arc shutes.

22. A rail gun switching system for switching high DC current fed into a first pair of generally rail parallel conductors from an electrical power source to a second pair of conductors, said switching system comprising:

a separate conductor disposed generally parallel to said first pair of conductors, an armature disposed between each conductor of said first pair of conductors and said separate conductor, means for initially restraining said armatures adjacent one end of said first pair of conductors, means for rapidly propelling said armatures from one end of said first pair of conductors to the other, said second pair of conductors being spaced from said one end of said first pair of conductors, an insulating strip disposed on each conductor of said first pair, a pair of insulation strips disposed on said separate conductor adjacent said insulating strips on said first pair of conductors, whereby multiple series arcs are formed between said armatures, said first pair of conductors and said separate conductor.

23. The switching system set forth in claim 22 and further comprising arc resistant inserts disposed adjacent the leading end of the insulating inserts on the associated conductor.

24. The switching system as sset forth in claim 22 wherein one of the conductors of the first pair has a gap disposed therein and one of the insulation strips is disposed over the gap and said second pair of conductors is individually connected to each portion of the one conductor of the first pair adjacent the gap.

25. The switching system as set forth in claim 22, wherein the conductors of the second pair of conductors is electrically connected to the respective conductors of the first pair of conductors.

* * * * *